US010729198B2

(12) United States Patent
Iwasaki et al.

(10) Patent No.: US 10,729,198 B2
(45) Date of Patent: Aug. 4, 2020

(54) SEAM RIPPER

(71) Applicant: Clover Mfg. Co., Ltd., Osaka-shi, Osaka (JP)

(72) Inventors: Chihiro Iwasaki, Osaka (JP); Atsushi Tanaka, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 72 days.

(21) Appl. No.: 16/134,281

(22) Filed: Sep. 18, 2018

(65) Prior Publication Data

US 2019/0104794 A1 Apr. 11, 2019

(30) Foreign Application Priority Data

Oct. 6, 2017 (JP) ..... 2017-195888

(51) Int. Cl.
*A41H 31/00* (2006.01)
*D05B 89/00* (2006.01)
*B26B 1/08* (2006.01)

(52) U.S. Cl.
CPC ..... *A41H 31/005* (2013.01); *B26B 1/08* (2013.01); *D05B 89/00* (2013.01)

(58) Field of Classification Search
CPC ..... A41H 31/005; D05B 89/00; B26B 5/003; B26B 1/08
USPC ..... 30/DIG. 8, 162; D3/18, 20, 28; 112/128, 112/129
See application file for complete search history.

(56) References Cited

U.S. PATENT DOCUMENTS 2,320,784 A * 6/1943 Livingston et al. ..... A41H 31/005 30/DIG. 8
2,710,448 A * 6/1955 Andrews ..... A41H 31/005 30/DIG. 8
2,764,814 A * 10/1956 Jecker ..... D05B 89/00 30/DIG. 8
3,100,935 A * 8/1963 Leafe ..... A41H 31/005 30/DIG. 8
4,175,498 A * 11/1979 Walters ..... D05B 89/00 112/129
5,297,340 A * 3/1994 Kahlcke ..... D05B 89/00 30/DIG. 8
D351,059 S * 10/1994 Kahlcke ..... D3/18
(Continued)

FOREIGN PATENT DOCUMENTS

DE 3231934 C2 * 10/1986 ..... D05B 89/00
JP 11977081340 U 6/1977
(Continued)

*Primary Examiner* — Jason Daniel Prone
(74) *Attorney, Agent, or Firm* — Hamre, Schumann, Mueller & Larson, P.C.

(57) ABSTRACT

A seam ripper includes a metal blade member, a handle and a slider. The blade member is supported by the handle and made of a shaft and a blade part at an end of the shaft. The slider causes the blade member to move between a retracted position and an advanced position. The shaft is housed in the handle at the retracted position. The blade part and at least a portion of the shaft are outside the handle at the advanced position. The blade part includes a cutting blade flanked by a needle portion and a ball-shaped portion. When the blade member is at the retracted position, the entirety of the needle portion is housed in the handle, and a portion of the cutting blade is exposed to the outside of the handle.

8 Claims, 5 Drawing Sheets

(56) References Cited

U.S. PATENT DOCUMENTS

| | | | | | |
|---|---|---|---|---|---|
| 5,896,667 | A * | 4/1999 | Hawkins | B26B 1/00 | 30/DIG. 3 |
| D418,672 | S * | 1/2000 | Mobbs | D3/18 | |
| D792,705 | S * | 7/2017 | Farnum | D3/18 | |
| D820,582 | S * | 6/2018 | Farnum | D3/18 | |
| 10,092,052 | B2 * | 10/2018 | Farnum | A41H 31/005 | |
| 10,219,567 | B2 * | 3/2019 | Farnum | A41H 31/005 | |
| 10,427,310 | B2 * | 10/2019 | Scimone | B26B 5/003 | |
| 2007/0125398 | A1 * | 6/2007 | Johnson | A45D 2/00 | 132/200 |
| 2014/0075762 | A1 * | 3/2014 | Gringer | B26B 5/003 | 30/162 |
| 2014/0182140 | A1 * | 7/2014 | Rosenhan | B26B 5/003 | 30/162 |
| 2014/0277042 | A1 * | 9/2014 | Racenet | A61B 17/320016 | 606/170 |
| 2019/0150544 | A1 * | 5/2019 | Farnum | A41H 31/005 | |

FOREIGN PATENT DOCUMENTS

| | | | | |
|---|---|---|---|---|
| JP | D1201385 | | 4/2004 | |
| JP | 2019068908 | A * | 5/2019 | A41H 31/005 |

* cited by examiner

SEAM RIPPER

FIELD

The present disclosure relates to a seam ripper for use to rip stitches.

BACKGROUND

A thread cutter called "seam ripper" is known as a tool to rip stitches. An example of such a seam ripper is disclosed in Japanese Design Registration No. 1201385. As disclosed therein, a typical seam ripper may include an elongated metal member coupled to a handle to be held by a user, and the metal member has, at its tip, a cutting blade flanked by a needle portion and a ball-shaped portion that provide a fork-like shape. In use, for example, the needle portion is inserted into a seam, and the seam ripper is pushed forward so that the cutting blade will cut the thread of the seam. The conventional seam ripper comes with a protective cap configured to cover the metal member (in particular, the cutting blade and the needle portion) when the ripper is not in use.

JP-U-S52-81340 discloses a seam ripper whose elongated metal member (with a fork-like end including a cutting blade) retractable into a handle. In this conventional seam ripper, the metal member is configured to slide into or out of the inner space of the handle by a screw mechanism. To use the seam ripper, the user rotates the operating portion of the handle, causing the blade part to come out gradually from the inside of the handle due to the screw mechanism. After the work with the ripper has been done, the user can bring the whole of the metal member back into the handle by rotating the operation portion in the opposite direction. Advantageously, such a configuration eliminates the need for preparation of an additional protective cap to cover the blade part.

SUMMARY

The present disclosure has been proposed under the above-noted circumstances, and an object of the disclosure is to provide a seam ripper that can be, for example, more comfortably and/or readily used than is conventionally possible.

According to an embodiment, there is provided a seam ripper provided with: a metal blade member including a shaft and a blade part provided at an end of the shaft; a handle supporting the metal blade member; and a slider that slides the metal blade member between a retracted position and an advanced position, where the shaft is housed in the handle at the retracted position, while the blade part and at least a portion of the shaft are positioned outside the handle at the advanced position. The blade part includes a cutting blade, a needle portion and a ball-shaped portion in a manner such that the needle portion and the ball-shaped portion are arranged to flank the cutting blade in a first direction perpendicular to an axis of the shaft. When the metal blade member is at the retracted position, the entirety of the needle portion is housed in the handle, while at least a portion of the cutting blade is exposed outside the handle.

Other features and advantages of the seam ripper will become apparent from the following detailed description with reference to the accompanying drawings.

DRAWINGS

EMBODIMENTS

Embodiments of the present disclosure are described below with reference to the accompanying drawings.

Figure 1:
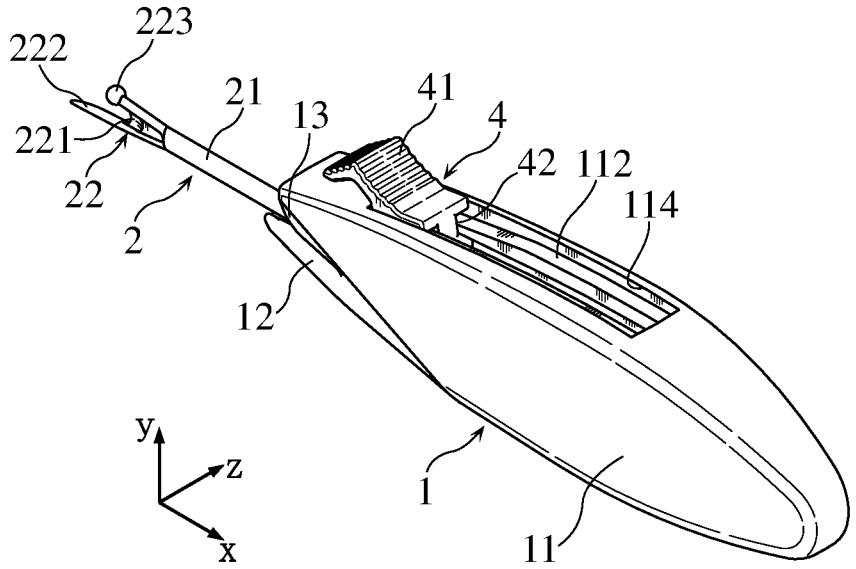
FIG. 1 is a perspective view of an embodiment of a seam ripper according to the present disclosure, with a metal blade member at an advanced position.
Figure 4:
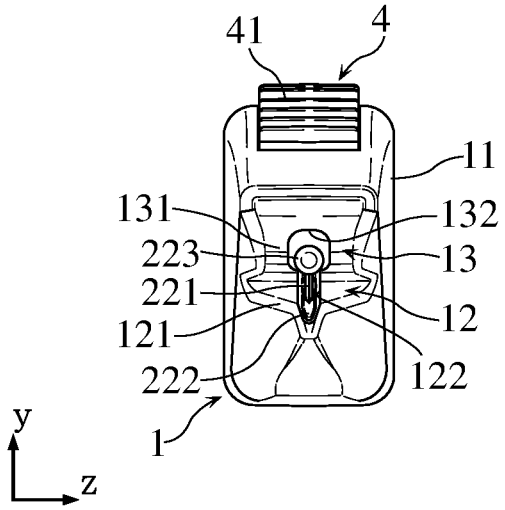
FIG. 4 is a left side view of the seam ripper shown in FIG. 1.

FIGS. 1-9 show an embodiment of a seam ripper according to the present disclosure. As shown in FIGS. 1 and 4, for example, the seam ripper includes a handle 1, a metal blade member 2, a slide base 3, an operating member 4, and a shaft support 5. The handle 1 is a part to be gripped by a user and configured to house at least a portion of a shaft 21 of the metal blade member 2, the slide base 3, and the shaft support 5. As will be described later, the handle 1 supports the metal blade member 2 via the slide base and the shaft support 5. The metal blade member 2 is slidable between the retracted position (shown in FIG. 7, for example) and the advanced position (shown in FIG. 2, for example) by a motion mechanism described later.

Figure 2:
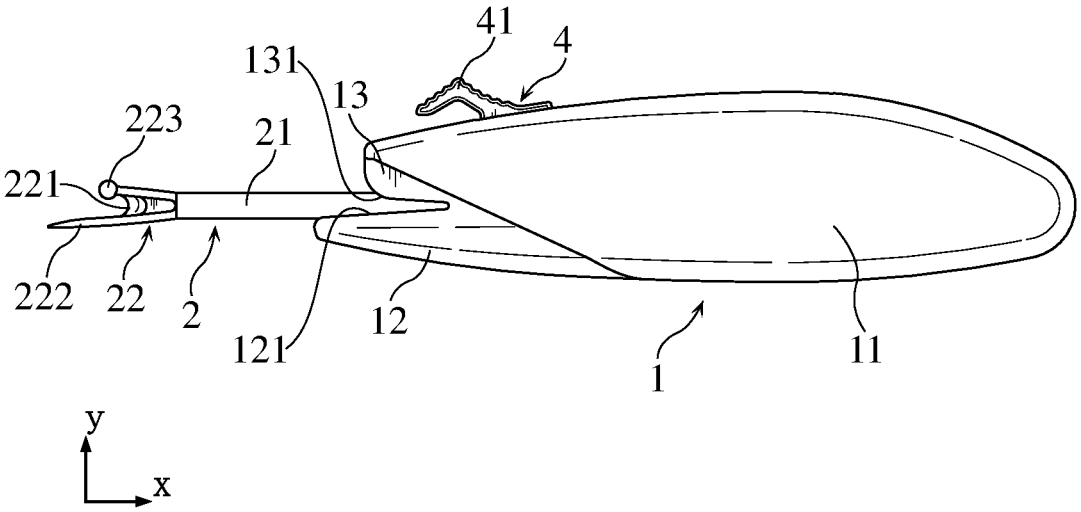
FIG. 2 is a front view of the seam ripper shown in FIG. 1.
Figure 3:
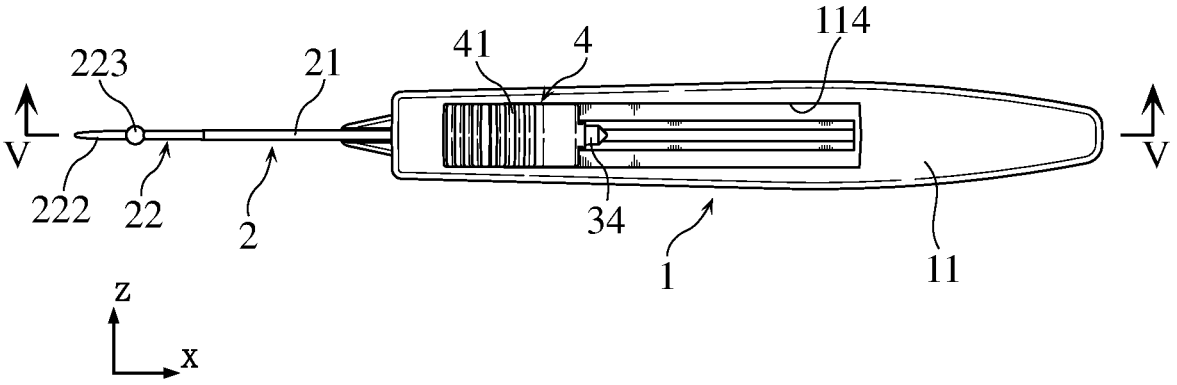
FIG. 3 is a plan view of the seam ripper shown in FIG. 1.

As shown in FIGS. 1 and 2, the metal blade member 2 has a shaft 21 and a blade part 22. The shaft 21 is elongated along a straight axis and has a generally elliptical cross section. The blade part 22 is provided at the distal or front end of the shaft 21. The blade part 22 includes a cutting blade 221, a needle portion 222 and a ball-shaped portion 223. The cutting blade 221 is connected to the distal end of the shaft 21 and has a cutting edge at a front side of the blade. The needle portion 222 and the ball-shaped portion 223 flank the cutting blade 221 to provide a fork-like shape. The metal blade member 2 may be formed by forging. The ball-shaped portion 223 may be provided by covering a tip of the metal blade part 22 with a resin.

The handle 1 has a main body 11, a first housing part 12, and a second housing part 13. The main body 11 constitutes most part of the handle 1. The main body 11 houses the shaft 21 when the metal blade member 2 is retracted.

Figure 7:
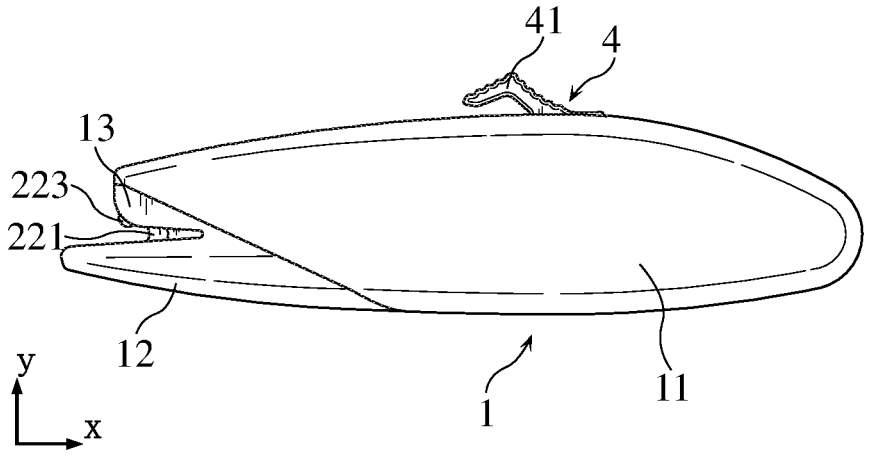
FIG. 7 is a front view of the seam ripper of FIG. 1, with the metal blade member of the seam ripper at a retracted position.
Figure 8:
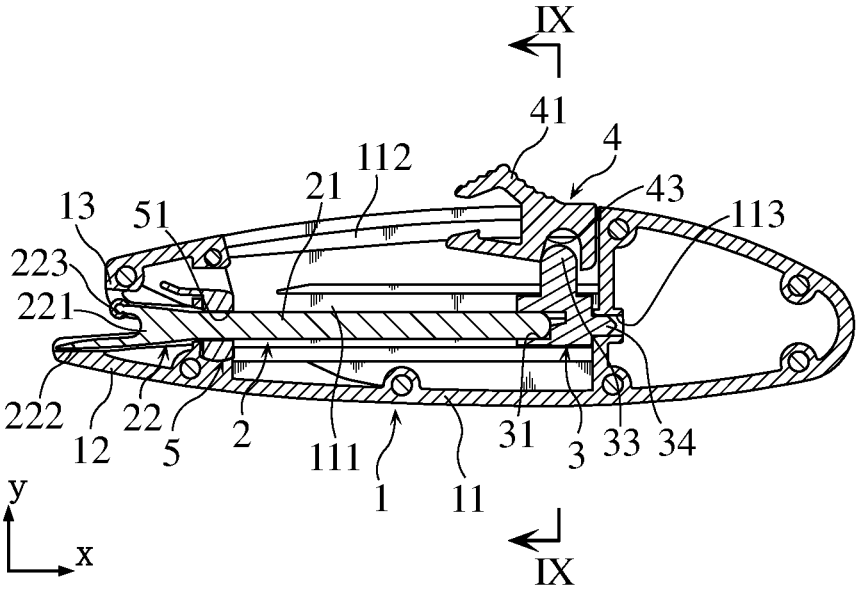
FIG. 8 is a sectional view corresponding to FIG. 5, showing the seam ripper with the metal blade member at the retracted position.

The first housing part 12 and the second housing part 13 are formed integral with and disposed on the front side of the main body 11. The first housing part 12 is configured to house the needle portion 222, as shown in FIG. 8. As shown in FIGS. 2 and 4, the first housing part 12 has a first guide surface 121. The first guide surface 121 is formed with a first opening 122 (see also FIG. 5) which the needle portion 222 can pass through. The second housing part 13 is configured to house at least a portion of the ball-shaped portion 223, as shown in FIG. 8. As shown in FIGS. 2 and 4, the second housing part 13 has a second guide surface 131. The second guide surface 131 is formed with a second opening 132 (see also FIG. 5) which the ball-shaped portion 223 can pass through. As shown in FIGS. 7 and 8, when the metal blade member 2 is at the retracted posit ion, the entirety of the needle portion 222 is housed within the handle 1. When the metal blade member 2 is at the retracted position, at least a portion of the cutting blade 221 (in particular the cutting edge) is exposed outside the handle 1 (see FIG. 7, for example).

Figure 5:
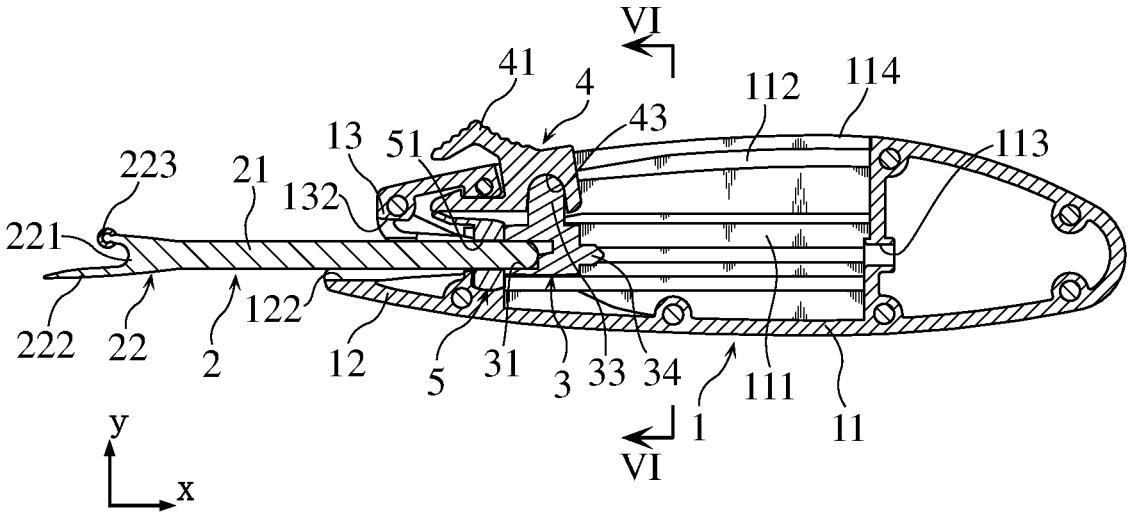
FIG. 5 is a sectional view taken along line V-V in FIG. 3.
Figure 6:
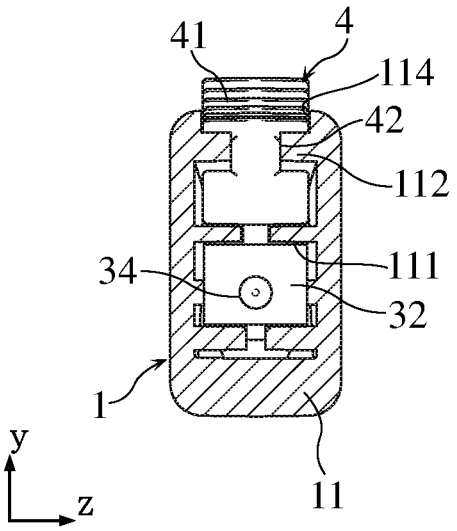
FIG. 6 is a sectional view taken along line VI-VI in FIG. 5.
Figure 9:
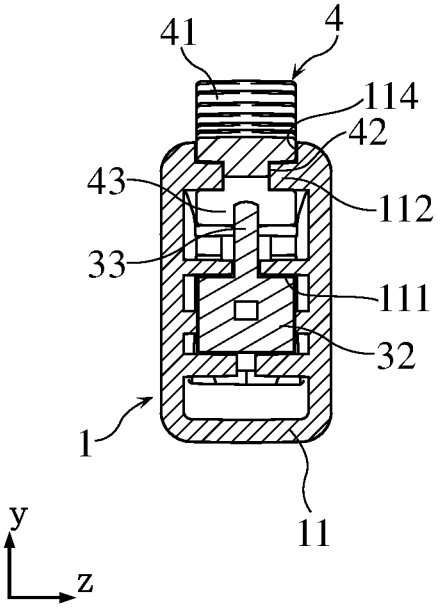
FIG. 9 is a sectional view taken along line IX-IX in FIG. 8.

As shown in FIGS. 5, 6 and 9, the main body 11 is internally formed with a first or lower guide 111 and a second or upper guide 112. The first guide (or guide passage) 111 is a hollow space configured to movably accommodate the slide base 3 so that the slide base 3 being moved can be guided along the passage. In the illustrated example, the first guide 111 is provided by a pair of opposed grooves each linearly extending in the direction x. Hence, the first guide 111 itself is straight along the direction x. In FIG. 6, a left-side groove (open to the right) and a right-side groove (open to the left) constitute the first guide 111. The second guide 112 is for guiding the movement of the operating member 4. In the illustrated example, the second guide 112 is provided by a pair of opposed strips each being elongated in the direction x. The second guide 112 is spaced apart from the first guide 111 in the direction y perpendicular to the direction x. The second guide 112 may be curved and/or bent so as to be outwardly convex, i.e., convex to the outside of the main body 11 (and hence the handle 1). Thus, the first guide 111 and the second guide 112 may be at least partially non-parallel to each other. When the second guide 112 is constituted by a pair of elongated strips, each strip may be partially or entirely curved and/or bent to be outwardly convex. In the illustrated example (see FIGS. 5 and 8), the entirety of each strip (hence the second guide 112) may be gently curved as proceeding forward so as to become closer (in the direction y) to the first guide 111. Alternatively, in the illustrated example, each strip (hence the second guide 112) may be partially curved (at least in a front portion of the strip) and partially straight (so that the vertical distance between the strip and the lower floor provided by a strip defining the first guide 111 may be substantially the same along the length of the straight portion). Further, the partial straight portion of the second guide 112 may be inclined with respect to the above-noted lower floor so that the vertical distance between the second guide 112 and the lower floor may become smaller as proceeding forward along the partial straight portion.

The handle 1 may be made of a synthetic resin having a suitable strength. For example, the handle 1 may be formed by integrally bonding a pair of parts in the direction z (perpendicular to both of the direction x and the direction y) by ultrasonic welding or by using an adhesive.

As shown in FIGS. 5, 6, 8 and 9, the slide base 3 includes a sliding fit member 32 and an engagement projection 33 formed integral with the sliding fit member 32. The sliding fit member 32 (hence the slide base 3) is formed with a shaft receiving hole 31 extending in the direction x and open to the front (to the left in FIG. 5) and also formed with an anchoring projection 34 on a side opposite to the shaft receiving hole 31. In the illustrated example, the sliding fit member 32 may be generally cuboid except for the hole 31 and the projection 34.

The base end of the shaft 21 of the metal blade member 2 is press-fitted into the shaft receiving hole 31, so that the shaft 21 (hence the metal blade member 2) is held by the slide base 3. The sliding fit member 32 is fitted in the first guide 111 of the main body 11 of the handle 1 so as to be movable along the first guide 111. Hence, the slide base 3 is slidable in the direction x along the first guide 111.

The engagement projection 33 projects from the sliding fit member 32 toward the operating member 4 in the direction y. The engagement projection 33 engages with an engagement recess 43 of the operating member 4.

The anchoring projection 34 is fitted into an anchoring hole 113 formed in the main body 11 of the handle 1 when the metal blade member 2 (shaft 21) is retracted. In the illustrated example, the anchoring hole 113 is formed in an inner plate or wall provided inside the main body 11. This inner plate or wall may serve as a stopper to prevent further retreat of the slide base 3 (hence the metal blade member 2) by direct contact with the slide base 3, as shown in FIG. 8. The anchoring projection 34 has an outer diameter that is approximately equal to or slightly larger than the inner diameter of the anchoring hole 113. Such a configuration can apply a relatively high resistance against the sliding movement of the metal blade member 2 when the metal blade member 2 is at the retracted position, so that the metal blade member 2 is held or retained releasably at the retracted position. In this regard, the anchoring projection 34 and the cooperating anchoring hole 113 constitute a releasable holding mechanism to hold or retain the metal blade member 2 releasably at the retracted position.

The shaft 21 of the metal blade member 2 is supported by the main body 11 of the handle 1 via the shaft support which is positioned offset forward (i.e., toward the distal end of the shaft 21) from the above-mentioned base end of the shaft 21. The shaft support 5 is formed with a through-hole 51, and a part of the shaft 21 is inserted into the through-hole 51. The size of the shaft 21 in cross section is approximately equal to (or slightly smaller than) that of the through-hole 51 so that the shaft can smoothly move back and forth along the direction x while being slidably supported by the shaft support 5. As described before, the base end of the shaft 21 is held by the slide base 3. Hence, as the slide base 3 is moved along the direction x, the shaft 21 (the metal blade member 2) is also moved in the direction x together with the base 3.

The operating member 4 includes a tongue 41 and a sliding fit member 42 formed with an engagement recess 43. The tongue 41 is a portion to be moved forward or backward with a user's finger for causing the metal blade member 2 to move accordingly, i.e., in synchronism with the tongue 41. The tongue 41 is positioned outside the handle 1 for allowing access of a user's finger. The tongue 41 has a mountain-like shape in front view of the seam ripper (as viewed in the direction z) and hence has inclined outer surfaces. The inclined outer surfaces are each formed with irregularities provided by e.g. a number of low protrusions (or shallow grooves) each having a predetermined length along the direction z. Such a configuration of the tongue 41 allows easy and secure contact of the tongue 41 with a finger. In the illustrated example, the tongue 41 is formed integral with the sliding fit member 42. In the illustrated example (see FIG. 6, for example), the sliding fit member 42 includes a relatively thin connecting portion (such as a web) and a wider (or larger) lower portion connected at its upper part to the connecting portion. The connecting portion extends through the slit 114 formed in the main body 11 of the handle 1.

The sliding fit member 42 is disposed below the tongue 41, in other words, disposed closer to the slide base 3 in the direction y than is the tongue 41. The sliding fit member 42 (precisely, the above-mentioned thin connecting portion) is slidably flanked by the second guide 112 of the main body 11 of the handle 1 and slidable in the direction x along the second guide 112. Hence, the operating member 4 is slidable in the direction x along the second guide 112.

The engagement recess 43 extends in the direction y and is recessed away from the slide base 3. Hence, the engagement recess 43 is open below to the slide base 3. The engagement recess 43 engages with engagement projection 33 of the slide base 3. Thus, when the operating member 4 (the tongue 41) is moved along the second guide 112, the slide base 3 and hence the shaft 21 or metal blade member 2 slide in the direction x.

As described above, the first guide 111 of the main body 11 of the handle 1 extends linearly in the direction x, and the slide base 3 slides linearly in the direction x along the first guide 111. On the other hand, the second guide 112 is curved or bent to be outwardly convex. In the illustrated example, the second guide 112 is gently curved so as to be away from the first guide 111 in the direction y to be outwardly convex. Thus, the second guide 112 and the first guide 111 are not parallel to each other.

The engagement projection 33 of the slide base 3 engages with (or links with) the engagement recess 43 of the operating member 4. Thus, the operating member 4 moving along the second guide 112 causes the slide base 3 to move along the first guide 111. Since the first guide 111 and the second guide 112 are not parallel to each other, the engagement depth of the engagement projection 33 with the engagement recess 43 changes in accordance with the position of the slide base 3 sliding along the first guide 111.

In the illustrated example, moving the operating member 4 along the second guide 112 causes the metal blade member 2 to move between the retracted position shown in FIG. 8 and the advanced position shown in FIG. 5. As understood from FIGS. 5 and 8, the engagement depth of the engagement projection 33 and the engagement recess 43 is relatively small when the metal blade member 2 is at the retracted position, while the depth is relatively large when the metal blade member 2 is at the advanced position. In the illustrated example, when the metal blade member 2 is at the advanced position, the tip of the engagement projection 33 is in press contact with the bottom of the engagement recess 43, which produces a reactional force urging the slide base 3 and the operating member 4 away from each other in the direction y. As a result, a relatively high resistance occurs against the movement of the slide base 3 and hence the metal blade member 2. In this manner, the press contact between the engagement projection 33 and the engagement recess 43 can apply resistance to the slide base 3 (and the operating member 4) so that the slide base 3 (hence the metal blade member 2) is held or retained releasably at the advanced position.

Alternatively, the engagement projection 33 may be provided on the operating member 4, while the engagement recess 43 may be provided in the slide base 3.

The seam ripper with the above-described configurations has the following advantages.

The seam ripper described above can be used to rip stitches one by one or in succession in a known manner. First, to prepare for use, the operating member 4 is slid forward to move the metal blade member 2 from the retracted position (FIG. 7) to the advanced position (FIG. 2). At the advanced position, the entirety of the blade part 22 is positioned outside the handle 1, and the blade part 22 is used to rip stitches. As described before, the blade part 22 has the needle portion 222 and the ball-shaped portion 223 that flank the cutting blade 221 to provide a fork-like shape. By pushing the seam ripper with the needle portion 222 inserted into a stitch of the seam, the thread of the stitch is cut with the cutting blade 221. For another stitch, the same operation is repeated. To rip a number of stitches in succession, on the other hand, the ball-shaped portion 223 is held in slidable contact with the cloth, while the needle portion 222 is spaced apart from the cloth. Keeping this state, the user runs the ball-shaped portion 223 along the seam on the cloth, so that the cutting blade 221 will catch (and cut) one stitch after another.

In the seam ripper of the present embodiment, when the metal blade member 2 is at the retracted position shown in FIGS. 7 and 8 (i.e., the ultimate position beyond which the metal blade member 2 is no more retractable), at least a portion of the cutting blade 221 is exposed outside the handle 1 (see FIG. 7, in which a part of the cutting blade 221 is exposed to the outside through a slit in the handle 1 as viewed in the direction z, where the slit is open forwardly so as to be able to catch a thread). The needle portion 222 as a whole, on the other hand, is housed in the handle 1 at the retracted position. Thus, even when the metal blade member 2 is at the retracted position, the exposed portion of the cutting blade 221 can cut a thread. At the same time, the needle portion 222 is housed in the handle 1, whereby sticking a finger with the needle portion 222 is prevented.

As described before, the handle 1 has the main body 11, and the first housing part 12 and second housing part 13 connected to the tip of the main body 11. As shown in FIG. 8, the main body 11 houses the shaft 21 when the metal blade member 2 is at the retracted position. The first housing part 12 has the first guide surface 121 formed with the first opening 122 which the needle portion 222 can pass through, and hence, is capable of housing the needle portion 222. The second housing part 13 has the second guide surface 131 formed with the second opening 132 which the ball-shaped portion 223 can pass through, and hence, is capable of housing at least a portion of the ball-shaped portion 223. The first guide surface 121 and the second guide surface 131 are configured to approach each other as proceeding toward the main body 11 (from the left to the right in FIG. 8). Such a configuration ensures proper housing of the needle portion 222 and at least a portion of the ball-shaped portion 223 in the handle 1 when the metal blade member 2 is at the retracted position. Further, even when the metal blade member 2 is at the retracted position, a thread can be cut just by putting the thread between the first guide surface 121 and the second guide surface 131 and letting it to be guided to the cutting blade 221 along the first guide surface 121 or the second guide surface 131.

The seam ripper has the slide base 3 movable along the first guide 111 and the operating member 4 movable along the second guide 112. The slide base 3 holds the base end of the shaft 21. The operating member 4 has the tongue 41 positioned outside the handle 1. The slide base 3 and the operating member 4 are linked to each other. With such a configuration, a simple operation of sliding the tongue 41 forward or backward in the direction x can produce a correspondingly swift sliding movement of the metal blade member 2, which is advantageous in using or putting away the seam ripper.

In the seam ripper according to the present embodiment, a relatively high resistance is applied against the sliding movement of the metal blade member 2 when the metal blade member 2 is at the retracted position (FIG. 7). In addition, a relatively high resistance is applied against the sliding movement of the metal blade member 2 when the metal blade member 2 is at the advanced position (FIG. 2). Thus, unintentional or accidental sliding movement of the metal blade member 2 is prevented from occurring at both of the advanced position and the retracted position.

Though an embodiment of the present disclosure is described above, the technical scope of the present disclosure is not limited to the particular embodiment. The specific configuration of each part of the seam ripper may be modified in various ways within the spirit of the present disclosure.

The invention claimed is:

1. A seam ripper comprising:

a metal blade member including an elongated shaft and a blade part provided at an end of the shaft;

a handle supporting the metal blade member; and a slider that slides the metal blade member relative to the handle between a retracted position and an advanced position, the shaft being housed in the handle at the retracted position, the blade part and at least a portion of the shaft being positioned outside the handle at the advanced position, the slider being engaged with the shaft of the metal blade member and slidably attached to the handle, wherein the blade part includes a cutting blade, a needle portion and a ball-shaped portion, the needle portion and the ball-shaped portion being arranged to flank the cutting blade in a first direction perpendicular to a longitudinal axis of the shaft, when the metal blade member is at the retracted position, an entirety of the needle portion is housed in the handle, at least a portion of the cutting blade is exposed outside the handle, a remaining portion of the cutting blade other than the at least a portion thereof is housed in the handle, and at least a portion of the ball-shaped portion is housed in the handle.

2. The seam ripper according to claim 1, wherein the handle includes a main body to house the shaft, a first housing part to house the needle portion, and a second housing part to house at least part of the ball-shaped portion, the first and the second housing parts being spaced apart from each other in the first direction and both connected to the main body, the first housing part comprises a first guide surface formed with a first opening to receive the needle portion, the second housing part comprises a second guide surface formed with a second opening to receive the ball-shaped portion, the first guide surface and the second guide surface are configured to approach each other as proceeding toward the main body.

3. The seam cutter according to claim 1, wherein the slider comprises: a slide base holding a base end of the shaft; an operating member held in engagement with the slider base and including a tongue provided outside the handle, the handle is provided with a first guide and a second guide, the first guide comprising a pair of opposed grooves cooperating to hold at least a portion of the slide base, each of the opposed grooves being elongated along the longitudinal axis of the shaft, and the second guide comprises a pair of opposed strips facing each other via a part of the operating member, each of the opposed strips being elongated substantially in the shaft longitudinal axis direction.

4. The seam ripper according to claim 3, wherein each of the opposed strips is spaced apart from the opposed grooves in the first direction and at least partially nonparallel to the opposed grooves.

5. The seam ripper according to claim 4, wherein each of the opposed strips is curved to be convex outwardly.

6. The seam ripper according to claim 3, wherein the slide base is provided with an engagement projection, and the operating member is provided with an engagement recess that receives at least a portion of the engagement projection.

7. The seam ripper according to claim 6, wherein the engagement projection and the engagement recess have a variable engagement depth depending on a position of the operating member along the second guide.

8. The seam ripper according to claim 1, wherein the slider is provided with an anchoring projection, and the handle comprises an inner wall formed with an anchoring hole for engagement with the anchoring projection so as to releasably hold the metal blade member at the retracted position.

* * * * *